United States Patent [19]

Harwood

[11] 4,387,540

[45] Jun. 14, 1983

[54] METHOD OF FORMING REFERENCE FLATS ON STYLI

[75] Inventor: Robert E. Harwood, Princeton, N.J.

[73] Assignee: RCA Corporation, New York, N.Y.

[21] Appl. No.: 298,587

[22] Filed: Sep. 2, 1981

[51] Int. Cl.[3] ..... B24B 1/00

[52] U.S. Cl. ..... 51/281 R; 414/416; 414/404

[58] Field of Search ..... 51/281 R, 281 SF, 238 R, 51/238 S, 323, 326; 369/173; 414/416, 404

[56] References Cited

U.S. PATENT DOCUMENTS

| | | | |
|---|---|---|---|
| 2,409,108 | 10/1946 | Crowley | 51/283 |
| 3,475,867 | 11/1969 | Walsh | 51/281 R |
| 4,098,030 | 7/1978 | Fuhrer et al. | 369/173 X |
| 4,165,584 | 8/1979 | Scherrer | 51/131.1 |
| 4,212,471 | 7/1980 | Nishiwaki et al. | 369/173 X |
| 4,343,585 | 8/1982 | Tedeschi | 414/404 X |

FOREIGN PATENT DOCUMENTS

| | | | |
|---|---|---|---|
| 2108445 | 9/1971 | Fed. Rep. of Germany | 51/281 R |

*Primary Examiner*—Harold D. Whitehead
*Assistant Examiner*—Robert A. Rose
*Attorney, Agent, or Firm*—Birgit E. Morris; Donald S. Cohen; Thomas H. Magee

[57] ABSTRACT

A method of forming reference flats on a plurality of styli comprises the step of placing the styli lengthwise in parallel grooves disposed adjacent the surface of a first plate, allowing the top portions of the styli to project above the surface. A coating of wax is applied to the flat surface of a second plate. The wax-coated second plate is then pressed against the surface of the first plate until the top portions of the styli are held firmly against the surface of the second plate, after which the second plate is lifted from the first plate with the styli remaining adhered to the second plate. The exposed portions of the styli are lapped to form the reference flats by moving an abrasive surface in a direction along the lengthwise orientation of the styli.

9 Claims, 4 Drawing Figures

METHOD OF FORMING REFERENCE FLATS ON STYLI

This invention relates to a method of forming reference flats on a plurality of styli.

BACKGROUND OF THE INVENTION

Information playback systems frequently utilize a stylus for reading signals from the surface of an information record, typically a plastic disc that contains stored video and audio information. In some systems the information record has a fine spiral groove to guide the tip of a stylus that contains a thin electrode. In these systems, the stylus tip is made of a material having sufficient hardness to withstand the abrasion caused from tracking the groove. Materials which possess such hardness, such as diamond, generally have a crystallographic structure which presents surfaces exhibiting different qualities depending upon which crystallographic plane the surfaces are oriented along. The video disc stylus utilized in the CED (capacitance electronic disc) system is tapered to form the prow of the tip, and is also lapped to form a keel having a V-shaped shoe for its bottom portion. Making a long-shanked stylus entirely from the same material may become expensive, particularly when the tip material, for example diamond, exceeds the cost of other suitable materials from which the shank can be made.

In order to reduce manufacturing costs, a metallic-shanked diamond audio stylus may be utilized as a starting structure from which to manufacture the video disc stylus. A typical audio stylus has a length of about 2.5 millimeters. The shank of the audio stylus comprises a titanium rod having a diameter of about 300 micrometers, at the end of which is mounted a randomly-oriented natural diamond stone in the shape of a 50 degree cone. In fabricating the desired structure from the diamond tip of the audio stylus, a reference surface is cut along a chord of the cylindrically-shaped metallic shank about 50 micrometers in from the circumference, in order to ensure that the proper orientation is achieved during each of the fabricating processes. The present invention provides a novel method of forming such reference flats along the cylindrical shanks of a plurality of audio styli.

SUMMARY OF THE INVENTION

The present invention comprises a method of forming reference flats on a plurality of styli wherein the styli are first placed lengthwise in parallel grooves disposed adjacent the surface of a first plate, allowing the top portions of the styli to project above the surface. A coating of wax is applied to the flat surface of a second plate. The wax-coated second plate is then pressed against the surface of the first plate until the top portions of the styli are held firmly against the surface of the second plate, after which the second plate is lifted from the first plate with the styli remaining adhered to the second plate. The exposed portions of the styli are lapped to form the reference flats by moving an abrasive surface in a direction along the lengthwise orientation of the styli.

DETAILED DESCRIPTION OF THE PREFERRED EMBODIMENT

Figure 1:
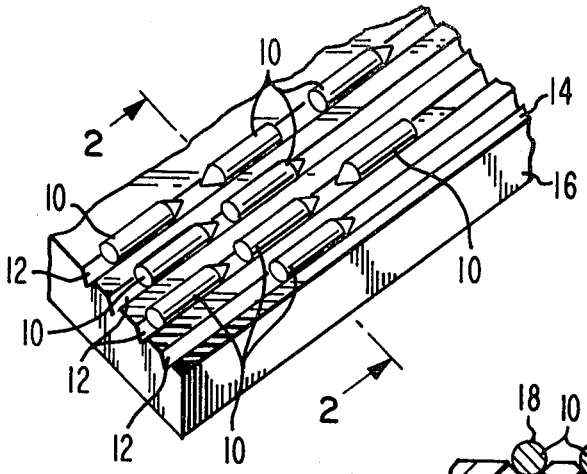
FIG. 1 is a partial perspective view illustrating one step of the present novel method.
Figure 2:
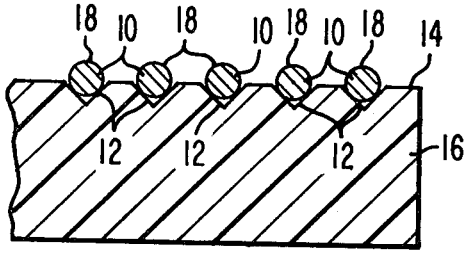
FIG. 2 is a partial cross-sectional view taken along line 2—2 of FIG. 1.

In FIGS. 1 and 2 of the drawing, there is shown the first step of the present method of forming reference flats on a plurality of styli 10. The styli 10 are placed lengthwise in parallel grooves 12 disposed adjacent the surface 14 of the first plate 16. The first plate 16 may be rectangular in shape having dimensions of 0.5 centimeter by 4 centimeters by 8 centimeters. Preferably, the grooves 12 are separated by a centerline spacing of approximately 500 micrometers. The depth of the grooves 12 should allow the top portions 18 of the styli 10 to project above the surface 14 of the first plate 16, as illustrated in FIG. 2. In the present embodiment, the styli 10 have a diameter of approximately 300 micrometers, and each of the grooves 12 comprises a 90 degree V-shaped groove having a depth of approximately 175 micrometers. This allows the top portions 18 of the styli 10 to project a distance of almost half the diameter above the surface 14 of the first plate 16. Preferably, the first plate 16 is made of a non-sticking material, such as polytetrafluoroethylene (Teflon), or coated therewith, for reasons explained further below.

In the present embodiment, the placing step is performed by first depositing the styli 10 at random upon the surface 14 of the first plate 16. A fine camel's hair brush is then moved back and forth, adjacent the surface 14 of the first plate 16, in a direction parallel to the grooves 12, in order to align the styli 10 in the grooves 12. Any excess styli 10 not resting in a groove 12 are brushed from the surface 14 of the first plate 16. The tips of the styli 10 will be pointing in opposite directions, and some space in the grooves 12 may not be filled. However, all the styli 10 will be aligned in the same direction.

The next step in the present method is to apply a coating 20 of adhesive material to the flat surface 22 of a second plate 24. The second plate 24 is approximately the same size as the first plate 16, but is ground flat without any grooves. Preferably, this second plate 24 is made of steel. In the present embodiment, the applying step is performed by heating the second plate 24 and applying a coating 20 of wax thereon. Preferably, the wax comprises a mineral wax such as Apiezon W wax, which is commercially available from James G. Biddle Company, Plymouth Meeting, Pennsylvania. In the present example, the coating 20 of wax is applied to a thickness of approximately 100 micrometers. The thickness of the coating 20 should not exceed the distance which the styli 10 project above the surface 14 of the first plate 16. The adhesive material may comprise any material which initially allows the styli 10 to become partially imbedded therein and then subsequently solidifies, thereby rigidly holding the styli 10 in the desired orientation. The material should also be one from which the styli 10 can be easily freed after a subsequent grinding step is performed.

Figure 3:
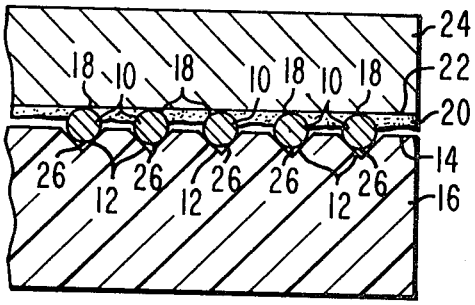
FIG. 3 is a partial cross-sectional view illustrating a further step of the present novel method.

The adhesive coating 20 on the surface 22 of the second plate 24 is now pressed against the surface 14 of the first plate 16 until the top portions 18 of the styli are held firmly against the flat surface 22 of the second plate 24, as shown in FIG. 3. In the present method, it is critical that the top portions 18 of the styli 10 "bottom out" so that they are positioned firmly against the flat surface 22 of the second plate 24. This is necessary in order to ensure that the reference flats, to be formed during a subsequent step, are uniformly positioned precisely at the same location for all styli 10. The hot wax plate 24 is allowed to cool for a few seconds in order to allow the wax coating 20 to set, and thereby become firmly adhered to the top portions 28 of the styli 10.

The second plate 24 is then lifted off from the first plate 16, whereby the styli 10 remain adhered to the second plate 24 and separate from the surface 14 of the first plate 16. The portions of the styli 10 which had been resting in the grooves 12 now become the exposed portions 26, adjacent which will be formed reference flats. By making the surface 14 of the first plate 16 out of a material which does not stick to the wax coating 20, such as polytetrafluoroethylene, the styli 10 and surrounding adhesive coating 20 are able to be separated easily from the first plate's surface 24. The styli 10 have now been transferred to the flat surface 22 of the second plate 24 and are all held lengthwise in the same parallel orientation by the adhesive coating 20.

Figure 4:
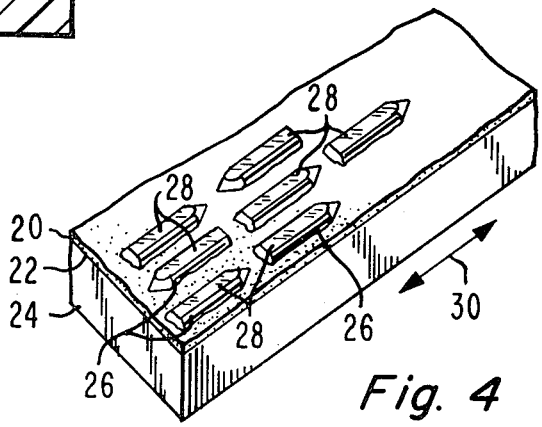
FIG. 4 is a partial perspective view illustrating the final step of the present novel method.

The final step comprises grinding the exposed portions 26 of the styli 10 to form reference flats 28 by moving an abrasive surface (not shown) in a direction along the lengthwise orientation of the styli, indicated by arrow 30 in FIG. 4. In the present embodiment, the grinding step is performed by hand-lapping the styli 10 utilizing 400-grit silicon carbide (SiC) paper (wet or dry) as an abrasive. It is critical that such grinding or lapping be done in a direction along the lengthwise orientation of the styli 10, i.e., along the direction of arrow 30, in order to prevent the styli 10 from shifting or moving while being held by the adhesive coating 20. I have discovered that an easily-removable adhesive material, such as Apiezon W wax, is not strong enough to hold the styli 10 in a rigidly fixed position while lapping the styli along a direction transverse to their lengthwise orientation. Consequently, it is necessary that all the styli 10 be oriented along the same lengthwise direction, and that the lapping or grinding force be applied along this direction in order to obtain the benefit of the relatively higher starting or static friction force needed to be applied along this direction before any undesirable movement of the styli 10 with respect to the second plate 24 occurs. In other words, a greater force is able to be applied along the lengthwise direction of the styli 10, before any undesirable shifting occurs, because of the greater surface area available to resist such movement between the styli 10 and adhesive coating 20. Any shifting or moving during the grinding step would cause unprecise reference flats to be formed. In the present embodiment, the grinding step is continued until each of the reference flats 28 has a depth of approximately 50 micrometers in from the circumference.

In performing the present method, it is emphasized that the adhesive coating 20 on the surface 22 of the second plate 24 must be pressed against the surface 14 of the first plate 16 until the top portions 18 of a plurality of the styli 10 are positioned firmly against the flat surface 22 of the second plate 24. The reason for this is that not all styli 10 have exactly the same diameter and, by pressing the first and second plates 16 and 24 firmly together, the exposed portions 26 of all the styli will be positioned equidistantly from the flat surface 22 of the second plate. Since the exposed portions 26 of the styli 10 will be the portions which are contacted by the flat abrasive grinding surface, the reference flats 28 will be formed at precisely the same location in from the circumference for all styli 10, thus ensuring uniformity in achieving proper orientation during subsequent processing steps. I have also discovered that it is necessary to actually press the adhesive coating 20, disposed on the second plate 24, against the first plate 16, in order to prevent the styli 10 from becoming dislodged from the orientation grooves 12. In other words, I have not found an adhesive material which can be successfully deposited over the surface 14 of the first plate 16 in order to rigidly hold the styli 10 in place during the grinding step. It is emphasized that such audio styli 10 have an extremely light mass, and any attempt to float a layer of adhesive material around the oriented styli 10 results in a plurality of the styli 10 becoming dislodged from the supporting grooves 12, causing changes not only in the critical equidistant spacing previously mentioned, but also in the lengthwise orientation. The present method provides a simple but effective technique which ensures that the reference flats 18 are uniformly positioned at precisely the same location for all styli 10.

What is claimed is:

1. A method of forming reference flats on a plurality of styli comprising the steps of:
   - placing the styli lengthwise in parallel grooves disposed adjacent the surface of a first plate, the depth of said grooves allowing the top portions of said styli to project above the surface of said first plate,
   - applying a coating of adhesive material to the flat surface of a second plate,
   - pressing the adhesive coating on the surface of said second plate against the surface of said first plate until the top portions of said styli are held firmly against the surface of said second plate,
   - lifting off said second plate from said first plate, whereby said styli remain adhered to said second plate and separate from the surface of said first plate, and
   - grinding the exposed portions of said styli to form reference flats by moving an abrasive surface in a direction along the lengthwise orientation of said styli.

2. A method as recited in claim 1 wherein said placing step is performed by
   - depositing said styli at random upon the surface of said first plate, and
   - moving a brush back and forth, adjacent the surface of the first plate, in a direction parallel to said grooves, whereby said styli become aligned in said grooves.

3. A method as recited in claim 2 wherein said brush comprises a fine camel's hair brush.

4. A method as recited in claim 1 wherein said applying step is performed by heating said second plate and applying a coating of wax thereon.

5. A method as recited in claim 1 wherein said grinding step is performed by hand-lapping said styli utilizing 400-grit silicon carbide (SiC) paper as an abrasive.

6. A method as recited in claim 1 wherein said first plate is made of polytetrafluoroethylene, and wherein the grooves therein are separated by a centerline spacing of approximately 500 micrometers, and wherein said second plate is made of steel.

7. A method as recited in claim 1 wherein each of said styli has a diameter of approximately 300 micrometers, and wherein each of said grooves comprises a 90 degree V-shaped groove having a depth of approximately 175 micrometers.

8. A method as recited in claim 7 wherein said coating of adhesive material is applied to a thickness of approximately 100 micrometers.

9. A method as recited in claim 8 wherein said grinding step is continued until each of said reference flats has a depth of approximately 50 micrometers in from the circumference.

* * * * *